US008001642B2

(12) United States Patent
Bordin et al.

(10) Patent No.: US 8,001,642 B2
(45) Date of Patent: Aug. 23, 2011

(54) SHOE TREE WITH VARIABLE GEOMETRY

(75) Inventors: Mauro Bordin, Montebelluna (IT); Sergio Cavaliere, Scorze (IT); Timm Flintoff, Portland, OR (US); Matteo Tessaro, Montebelluna (IT)

(73) Assignee: Nike, Inc., Beaverton, OR (US)

( * ) Notice: Subject to any disclaimer, the term of this patent is extended or adjusted under 35 U.S.C. 154(b) by 991 days.

(21) Appl. No.: 11/421,944

(22) Filed: Jun. 2, 2006

(65) Prior Publication Data

US 2007/0089249 A1 Apr. 26, 2007

(30) Foreign Application Priority Data

Jun. 7, 2005 (IT) ..... M12005A001051

(51) Int. Cl.

| | |
|---|---|
| ***A43D 5/00*** | (2006.01) |
| ***A43D 15/00*** | (2006.01) |
| ***A43D 19/00*** | (2006.01) |
| ***A43D 95/00*** | (2006.01) |
| ***A43D 3/00*** | (2006.01) |

(52) U.S. Cl. ..... 12/115.8; 12/114.6; 12/116.8; 12/128 B

(58) Field of Classification Search ..... 12/112, 12/114.6, 114.8, 115.2, 115.4, 115.6, 115.8, 12/116.4, 116.8, 117.2, 123.5, 128 B; D2/979
See application file for complete search history.

(56) References Cited

U.S. PATENT DOCUMENTS

| | | | | |
|---|---|---|---|---|
| 1,222,470 | A * | 4/1917 | Ross | 12/115.6 |
| 1,402,712 | A | 1/1922 | Brady | |
| 1,568,432 | A | 1/1926 | Weise | |
| 1,631,786 | A | 6/1927 | Battilani | |
| 1,759,566 | A * | 5/1930 | Dami | 12/115.6 |
| 1,865,117 | A * | 6/1932 | Legge | 12/115.6 |
| 1,999,150 | A * | 4/1935 | Eddins | 12/116.8 |
| 2,111,669 | A * | 3/1938 | Lazarus | 12/116.8 |
| 2,401,064 | A * | 5/1946 | Garneau | 12/116.8 |
| 2,436,313 | A * | 2/1948 | Lesavoy | 12/116.6 |
| 2,510,315 | A * | 6/1950 | Malberg | 12/117.4 |
| 2,689,365 | A * | 9/1954 | Koskela | 12/116.2 |
| 2,744,270 | A * | 5/1956 | Moses | 12/116.8 |
| 2,787,013 | A * | 4/1957 | Moses | 12/115.8 |
| 3,435,475 | A | 4/1969 | Bisk | |
| 3,772,722 | A | 11/1973 | Gellert | |
| 5,230,115 | A * | 7/1993 | Hollister et al. | 12/128 B |
| 6,192,540 | B1 * | 2/2001 | Tsung-Ping | 12/128 R |
| 6,883,197 | B2 * | 4/2005 | Tak | 12/115.8 |

FOREIGN PATENT DOCUMENTS

GB 809859 3/1959

* cited by examiner

*Primary Examiner* — Jila M Mohandesi
*Assistant Examiner* — Melissa L Lalli
(74) *Attorney, Agent, or Firm* — Banner & Witcoff, Ltd.

(57) ABSTRACT

A shaping apparatus for an article of footwear is provided to maintain the shape of an upper. An insertable apparatus includes a toe shaping member. A medial shaping member may engage a medial side of the upper. A lateral shaping member may engage a lateral side of the upper. The medial shaping member and lateral shaping member are resiliently disposed on the toe shaping member. A rear biasing member may be attached to the medial shaping member and the lateral shaping member.

17 Claims, 13 Drawing Sheets

SHOE TREE WITH VARIABLE GEOMETRY

CROSS REFERENCE TO RELATED APPLICATIONS

This application claims the benefit of priority to Italian Patent Application No. MI2005A001051 filed in Italy on Jun. 7, 2005 further, the present application is a continuation of International Patent App. No. PCT/US06/19944, filed on May 24, 2006 in the English Language which claims the benefit of priority to Italian Patent No. MI2005A001051, the contents of the noted applications are incorporated by references herein.

FIELD OF THE INVENTION

The present invention generally relates to an article of footwear. More specifically, the invention relates a shaping device for an article of footwear designed to maintain the shape of an upper.

BACKGROUND OF THE INVENTION

The modem athletic shoe is a combination of many elements which have specific functions, all of which must work together for the support and protection of the foot during an athletic event. Numerous consumers and athletes purchase footwear for use in athletic activities such as running, cross training, soccer, football, baseball, basketball, tennis, walking, and the like. The shoes worn by the athlete can effect the performance and contribute to their overall success in an athlete event.

Proper fitting and comfortable shoes are important for foot development and athletic performance. One function of a shoe is to support and protect the foot. To this end, a shoe, typically an athletic shoe, includes a sole to provide traction, support and cushioning. A shoe also includes an upper that is typically stitched and/or glued to the upper periphery of the sole. The upper is intended to contact and hold the foot of the wearer to the sole, to provide a tight and comfortable fit. The upper typically also has a fastening system, such as a lace and eyelets in the upper material. The ends of the lace are tied together so the upper squeezes the foot within the shoe.

The shape of the upper of athletic footwear is an important consideration for athletic performance. Uppers are frequently constructed of leather or other materials having properties similar to leather. Leather and other similar materials may retain moisture and do not permit the foot to readily breathe. The foot may generate an excessive amount of moisture and may become hot or overheated in such an upper construction. When an athletic shoe is used in hot weather, the temperature and moisture within the interior space of the upper may become elevated. After use of the footwear, the upper generally deforms from the intended shape provided by the manufacturer. As a result, the upper may not have a good fit around the foot of the wearer. This problem can adversely effect the overall comfort and the fit of the shoe which can lead to a loss of forward propulsion, or adversely effect kicking and foot planting performance, such as in the sport of soccer.

The interior of the upper or the surface of a shoe tree can be a haven for the growth of microorganisms or microbes. In hot wet environments, sweat and interior surfaces of the upper can create a unique ecological site that provides a large surface area, favoring the accumulation of bacteria. Bacteria residing in the upper material play an important role in the development of malodor emanating from a shoe or other aliments. Heretofore, there has not been an effective method to kill bacteria or prevent growth while maintaining the shape of the upper.

In view of the foregoing, there is a need for shaping device for an upper that overcomes the deficiencies in the past.

SUMMARY OF THE INVENTION

The present invention pertains to a shaping apparatus for an article of footwear provided to maintain the shape of an upper.

In another aspect, there is provided a shoe tree apparatus including a toe shaping member. A plurality of opposing shaping members are disposed reward of the toe shaping member and the one of the shaping members is configured for biasing against an upper of a shoe and is biased with respect to toe shaping member. Further, an intermediate member extends from the toe shaping member and is biased therefrom.

In another aspect, there is provided a shoe tree apparatus with members that are insertably configured for maintaining the shape of an upper of an article of footwear. The shoe apparatus include a toe shaping member, a medial member, and lateral member arranged for engaging the upper. A central member extends from the toe shaping member and is biased therefrom. The medial member and the lateral member are provided in a biased relation with the toe shaping member.

In a further aspect, there is provided a shoe tree apparatus including a toe shaping member; a medial member for engaging a medial side of an upper; a lateral member for engaging a lateral side of an upper. A central member extends from the toe shaping member and is biased for shaping an upper. A spring assembly is connected to the medial member and the lateral member for biasing against the toe shaping member.

In a further aspect, there is provided a shoe tree apparatus for an upper of a shoe. The shoe tree apparatus includes a toe shaping member; a plurality of opposing shaping members disposed reward of the toe shaping member and the shaping members engage a medial side of an upper and a lateral side of an upper. A central member extends from the toe shaping member and is biased therefrom. The members are molded and provided with a dischargeable substance.

In another aspect, there is provided a shoe tree apparatus including a toe shaping member. A plurality of opposing shaping members are disposed reward of the toe shaping member and the one of the shaping members is configured for biasing against an upper of a shoe and is biased with respect to toe shaping member. Further, an intermediate member extends from the toe shaping member and is biased therefrom.

In another aspect, there is provided a shoe tree with a means for placing a tensile force on an upper of an article of footwear including a toe shaping means, medial and lateral shaping means and a central shaping means.

These and other aspects, features and advantages of the present invention will be readily apparent and fully understood from the following detailed description of preferred embodiments, taken in connection with the appended drawings, which are included by way of example and not by way of limitation with regard to the claimed invention, in which like reference numerals identifying the elements throughout.

DETAILED DESCRIPTION OF THE PREFERRED EMBODIMENTS

Figure 1:
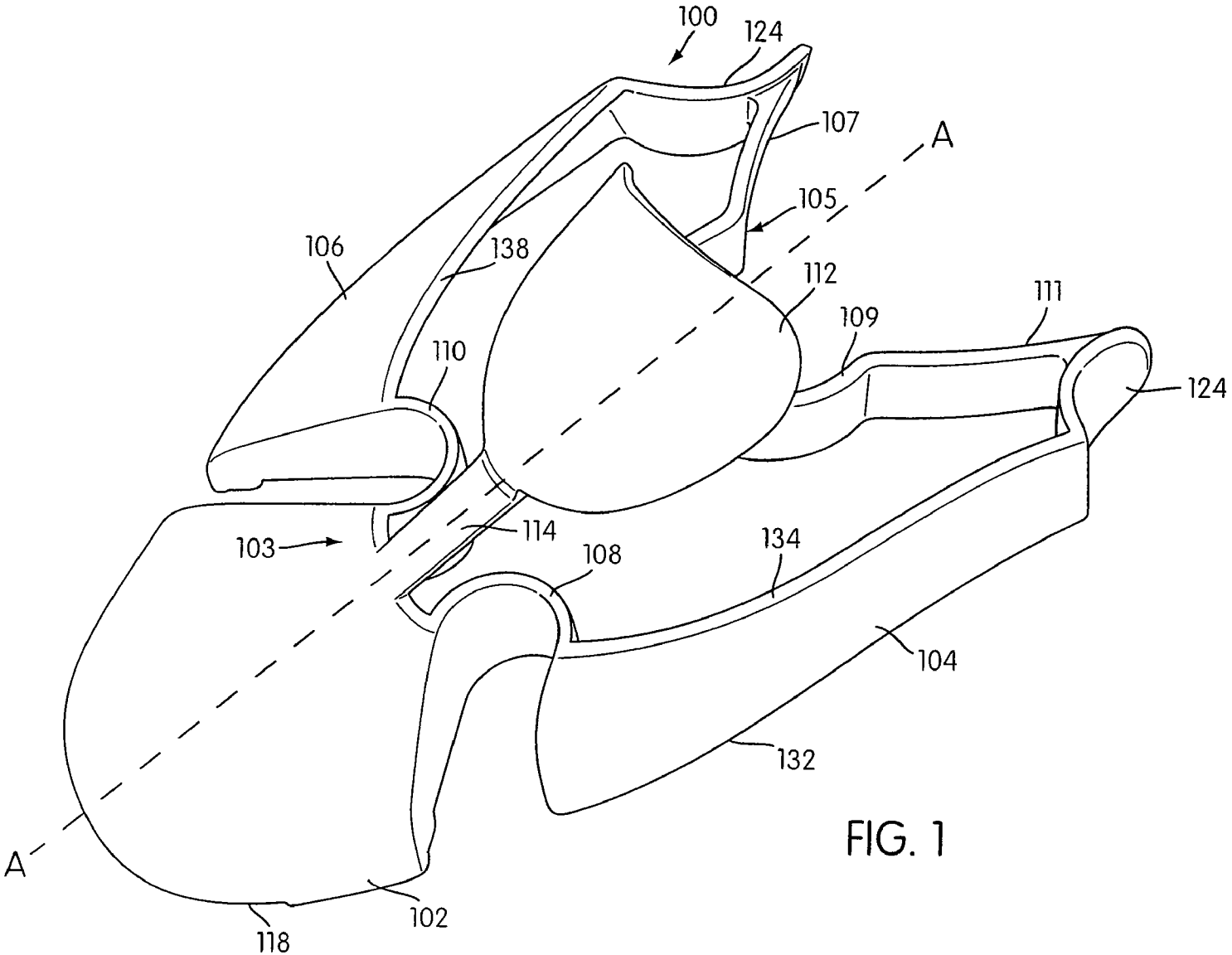
FIG. 1 is a perspective view of an upper shaping device according to one or more aspects of the present invention.
Figure 2:
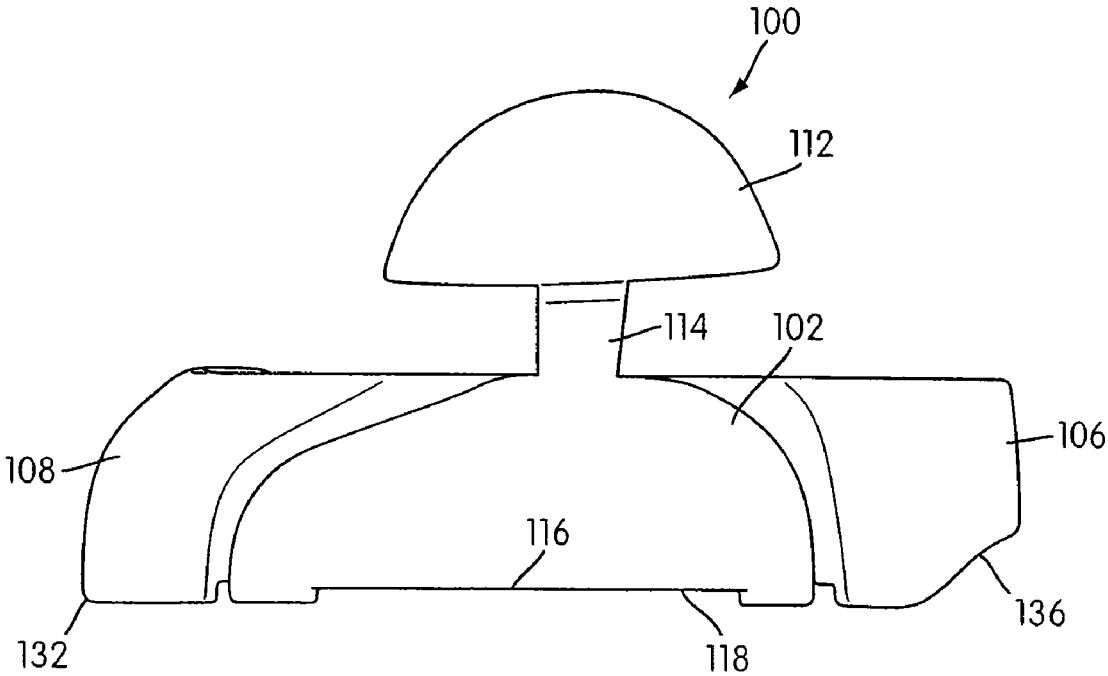
FIG. 2 is a front view of the shaping device of FIG. 1.

FIGS. 1-14 illustrate various embodiments of a shoe upper shaping device 100, 200, 300 which is generally referred to herein as a shoe tree. Shoe tree 100 provides a high degree of shape retention of the upper 12 of a shoe 10 (see FIG. 9). The variable geometry of shoe tree 100 is adaptable to different upper shapes and sizes by way of a resiliently biased construction. This construction enables adaptability to the upper shape. Shoe tree 100 is provided so as to maintain as much as possible the original upper shape before use by a wearer of the shoe 10. This shaping function is broadly practiced by applying biasing pressure in multiple directions to stretch the upper 12 away from the sole 20.

Figure 9:
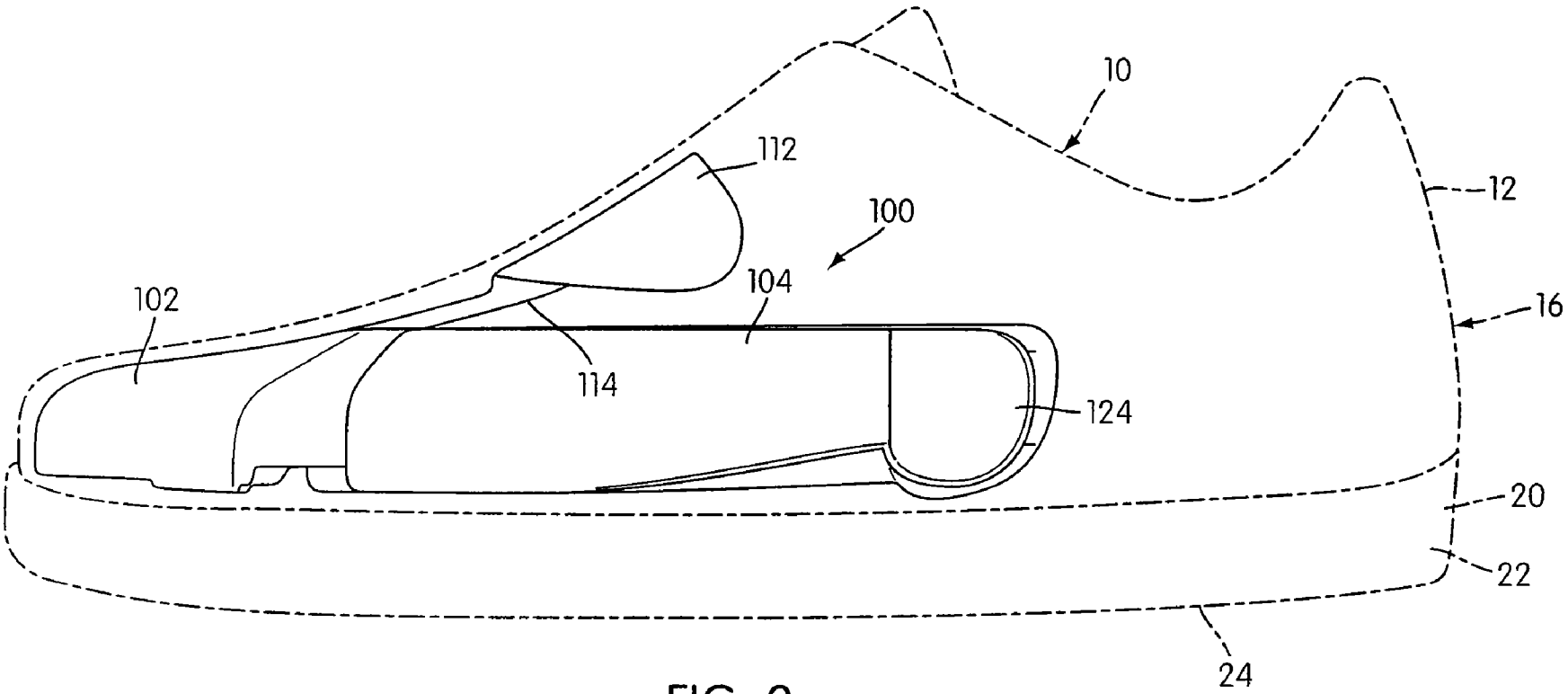
FIG. 9 is a side view of an upper shaping device superimposed within an article of footwear illustrating an operating environment.

Referring to FIG. 9, sole 20 attenuates ground reaction forces and absorbs energy as the footwear contacts the ground, and may incorporate multiple layers that are referred to as a midsole 22 and an outsole 24. The midsole 22 forms the middle layer of the sole. The outsole 24 forms the ground-contacting element of footwear and may be fashioned from a durable, wear resistant material that includes texturing to improve traction. The midsole 22 provides cushioning and support and is more compressible than outsole 24 to achieve its cushioning function. The midsole 22 may be composed of resilient foam material, such as polyurethane (PU) open cell, PU closed cell, or a similar material. Nevertheless, shoe 10 can be wide variety of constructions, such as cleated article of footwear. Further, sole 20 may be an outsole plate construction, rather a midsole/outsole construction. Additionally, sole 20 may include air bladders and the like for cushioning performance.

Continuing with FIG. 9, the upper 12 is secured to the sole 20 in a conventional manner such as, stitching or adhesive bonding and forms a void on the interior of the article of footwear 10 for securely and comfortably receiving a foot of a wearer. Upper 12 of shoe 10 can be made of any desirable material or a combination of materials such as, split-leather, full-grain leather, suede, polyester, nylon, or a breathable mesh. For ease of explanation, upper 12 includes a medial side 16 and a lateral side. When the upper 12 is worn the lateral side generally faces away from the center line of a user's body. Likewise, the medial side 16 generally faces inward towards the centerline of a user's body. The terms forefoot region, midfoot region, and rearfoot region as used herein generally correspond to the locations of the forefoot, midfoot, and rearfoot of a wearer as would be understood by one of ordinary skill in the art. For ease of explanation, a heel-to-toe axis A-A is generally defined herein as the direction when a wearer of shoe 10 is moving in a forward motion (see FIG. 6). This heel-to-toe axis A-A generally bisects through the center of the shoe tree 100 for designating medial and lateral halves or sides.

With reference to FIG. 1-9, shoe tree 100 comprises a variable geometry adaptable to different last shapes and sizes. In a preferred construction, the adaptable nature of shoe tree 100 is generally based on a resiliently biased configuration of the parts. For example, shoe tree 100 comprises shaping members or shaping portions, such as a toe portion 102 which maintains the shape of the forefoot toe region of the upper 12. The toe portion 102 may be resiliently connected to a medial portion 104 and a lateral portion 106 via a spring assembly 103. In one arrangement, medial portion 104 and lateral portion 106 are rearwardly interconnected by way of a biasing element or rear spring 105. Shoe tree 100 includes a central or intermediate portion 112 which extends in a resilient cantilevered manner upwardly from the toe portion 102. The intermediate portion 112 is connected to the toe portion 102 by way of a resilient biasing element or spring 114.

Figure 4:
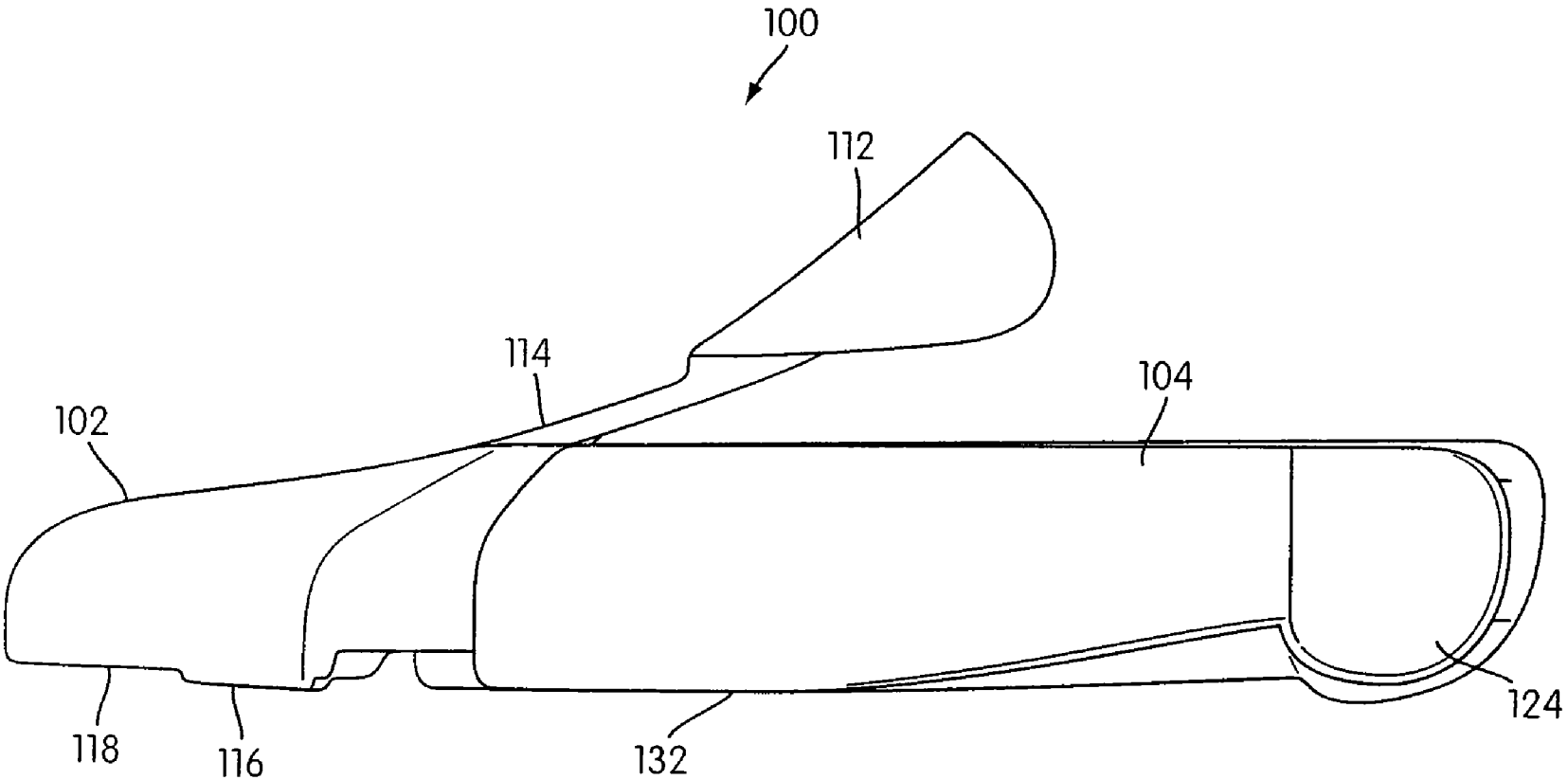
FIG. 4 is a side view of one side of the shaping device of FIG. 1.
Figure 5:
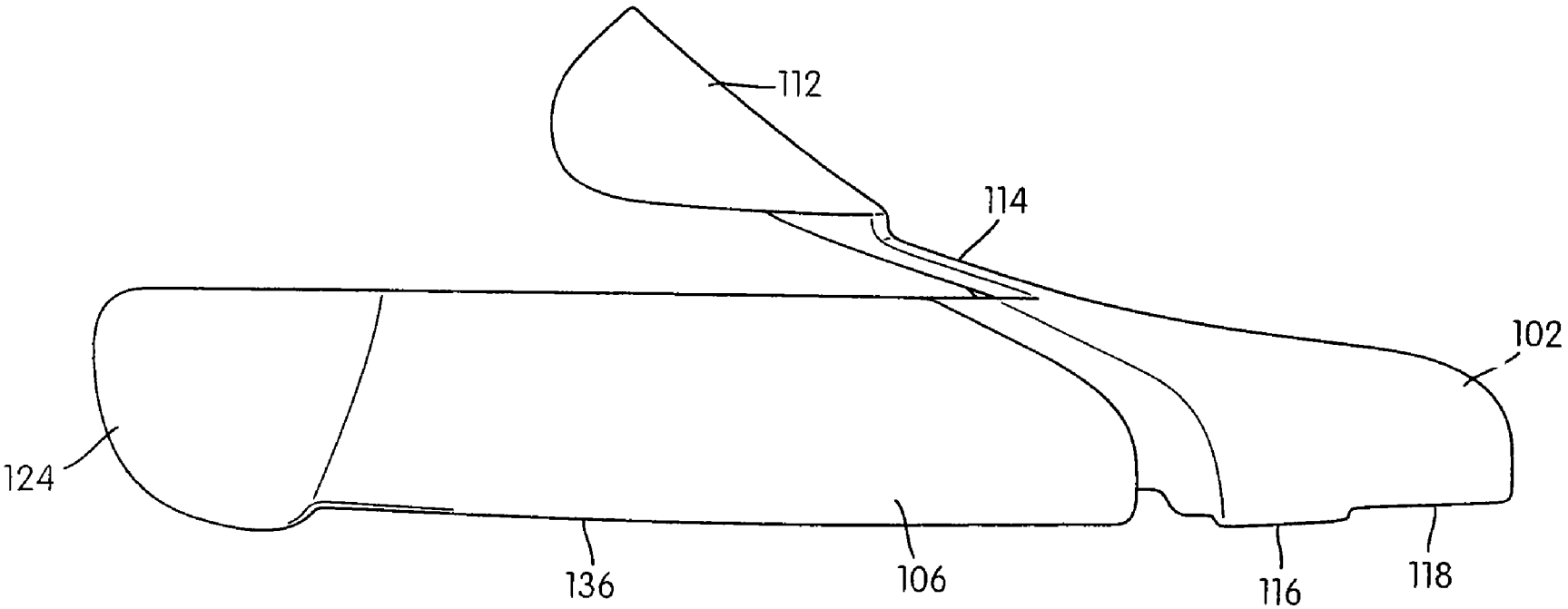
FIG. 5 is a side view of the other side of the shaping device of FIG. 1.

Toe portion 102 includes a forward edge 116 which is extends rearward into a tapered construction shown in FIGS. 4-5. The toe portion 102 has a gradual tapered surface for matching the toe box of the upper 12 and for more uniformly transferring forces to the upper 12. This tapered construction reduces pointing loading to the material of the upper 12 and prevents localized point loading damage. Shoe tree 100 is provided to be more easily insertable into shoe 10. In one construction, the forward edge 116 of toe portion 102 includes a notched or bevel void 118 to enable improved insertion to thereby avoid interior obstructions in the upper 12. For example, the shoe 10 may include a portion of the shoe 10 that is in contact with the bottom of the foot of the wearer (e.g. a footbed). A footbed may be formed by a sockliner disposed inside of the shoe 10 and positioned between the foot of the wearer and the sole 20. The footbed may have curved surfaces and other obstructions. The construction of the toe portion 102 with the bevel void 118 advantageously avoids these obstructions.

Continuing with the toe portion 102, spring assembly 103 may include, for example, a plurality of opposing spring members comprising a medial spring member 108 and a lateral spring member 110, respectively connected to the medial portion 104 and lateral portion 106 of shoe tree 100. Spring members 108, 110 are preferably formed to be resiliently flexible along a transverse direction along the length, like leaf springs. In a preferred construction, the spring members 108, 110 are provided in a form of a curved leaf spring. In a further construction, the leaf spring is more a loop or U shape e.g., a central curved portion connected between two straight leg portions. Nevertheless, only medial spring member 108 or lateral spring member 110 may be provided on shoe tree 100 (See FIG. 11-14). Spring members 108, 110 may be made from a material exhibiting sufficient resilience and/or resistance to material fatigue.

In one example of the present invention, spring members may be made from molded material, such as appropriate plastic material. A medial spring opening is formed between the toe shaping member 102 and the medial portion 104 and a lateral spring opening is formed between the toe shaping member 102 and the lateral portion 106 such that the toe shaping member is separated and spaced from the medial and lateral portions by the medial and lateral spring openings respectively.

As shown in FIGS. 1-10, medial portion 104 and lateral portion 106 each have a tapered construction beginning at the outermost edge 132, 134 and extending inwardly towards the heel-to-toe axis A-A of the shoe tree 100 to inner edge 136, 138. The medial portion 104 and the lateral portion 106 apply an outer biasing force to the inner surfaces of the upper. In this configuration, medial portion 104 and lateral portion 106 engage or otherwise push against the upper 12. In this manner, the material forming the upper may be placed under tensile stress. The tapered construction of medial portion 104 and lateral portion 106 reduces pointing loading applied to the material of the upper 12 and prevents localized point load damage. Further, the medial portion 104 and lateral portion 106 spread outward (traverse to heel-to-toe axis A-A) to reliably match the internal upper shape thereby keeping the shoe tree 100 disposed forward in shoe 10. Hence, once the shoe tree 100 is engaged within the upper 12, the shoe tree 100 avoids slipping rearward towards the heel of shoe 10. Optionally, the top surface of the portions 102, 104, 106 can be provided with a texturing to avoid the shoe tree slipping back when it is positioned inside the shoe upper 12. For example, the texturing may be in the form of protrusions such as ridges or hemispheres or other shapes.

As previously noted, the intermediate portion 112 is connected to the toe portion 102 by way of a resilient biasing element or spring 114. The intermediate portion 112 of shoe tree 100 provides an angular biasing force to the top region of the upper 12. In this configuration, the intermediate portion 112 pushes simultaneously upward and rearward to maintain the shape of the upper. Spring 114 is a band of material. In the cantilevered arrangement, a rib 130 may be provided on the underside of the toe portion 102 and spring 114. Rib 130 spans into the longitudinal length of spring 114 and into the toe portion 102 for provide stiffness at the proximal end attached to toe portion 102. These noted configurations advantageously allow the shoe tree 100 to function in different ways and at specific locations for upper shape retention and prevent damage from point loading.

Figure 3:
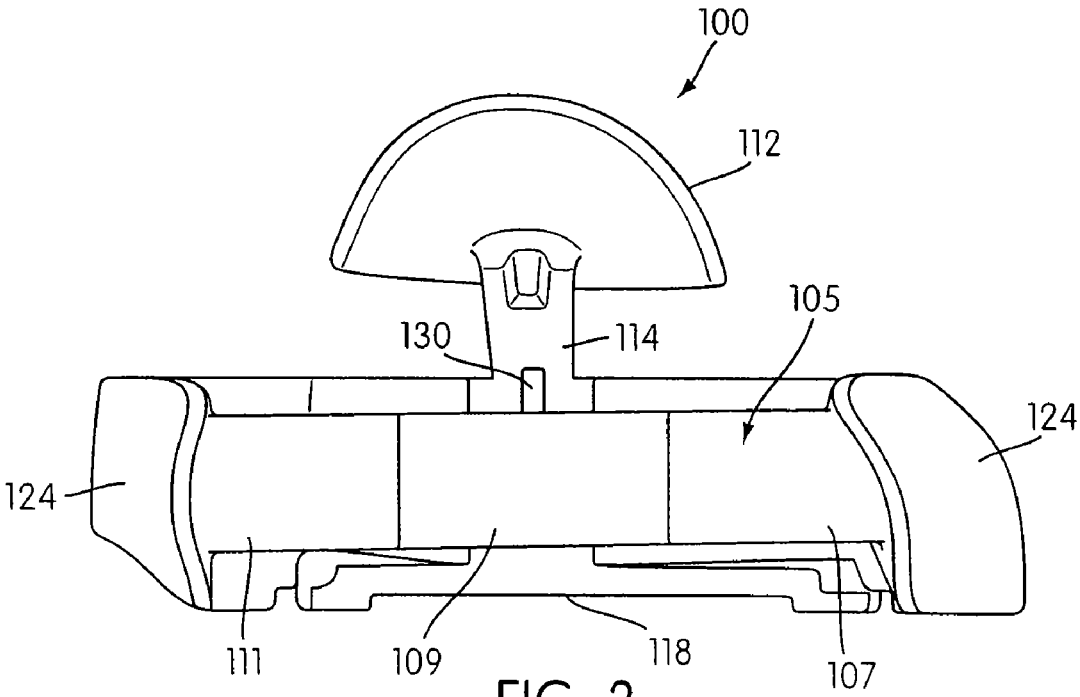
FIG. 3 is a rear view of the shaping device of FIG. 1.
Figure 6:
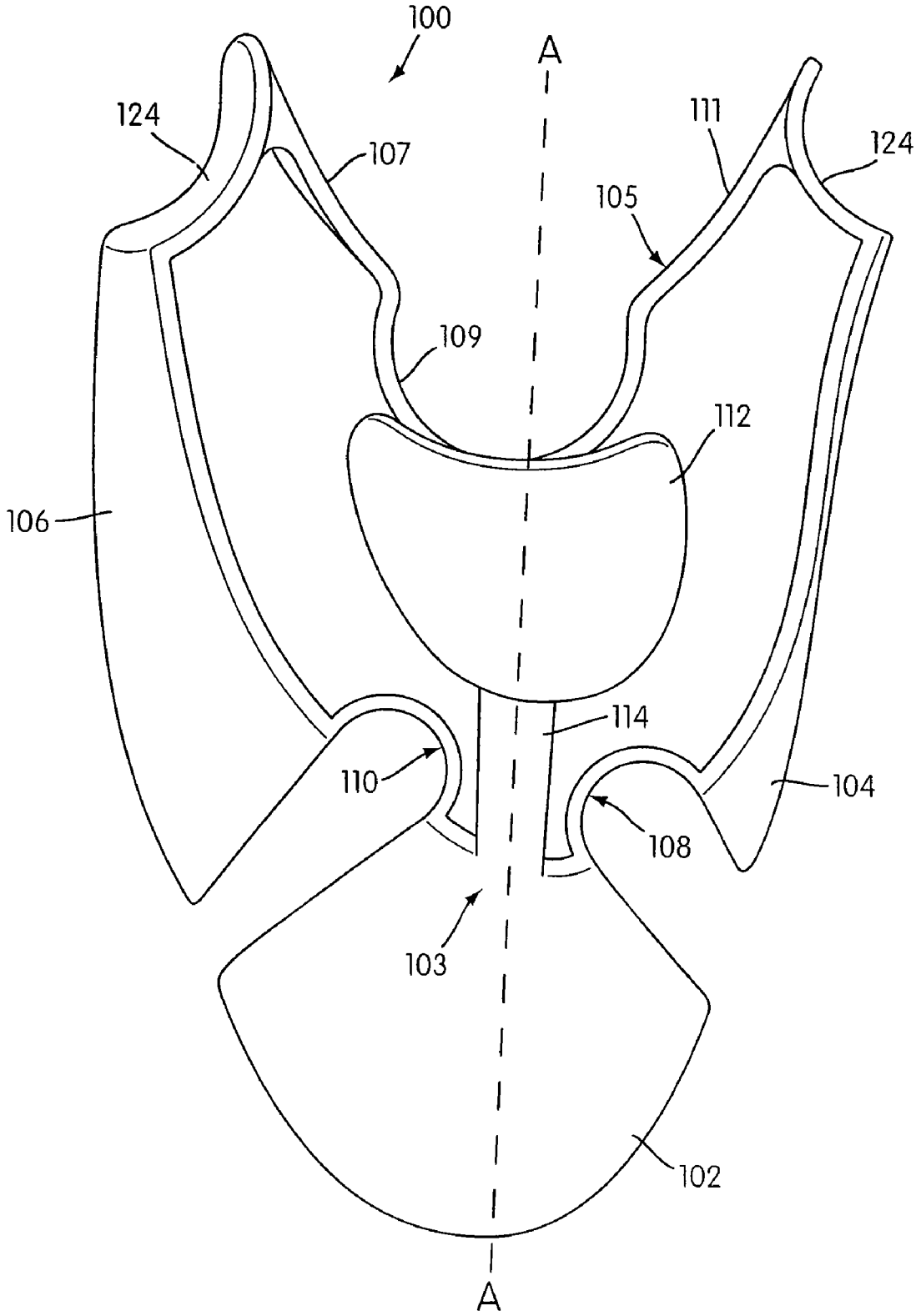
FIG. 6 is a top plan view of the shaping device of FIG. 1.
Figure 7:
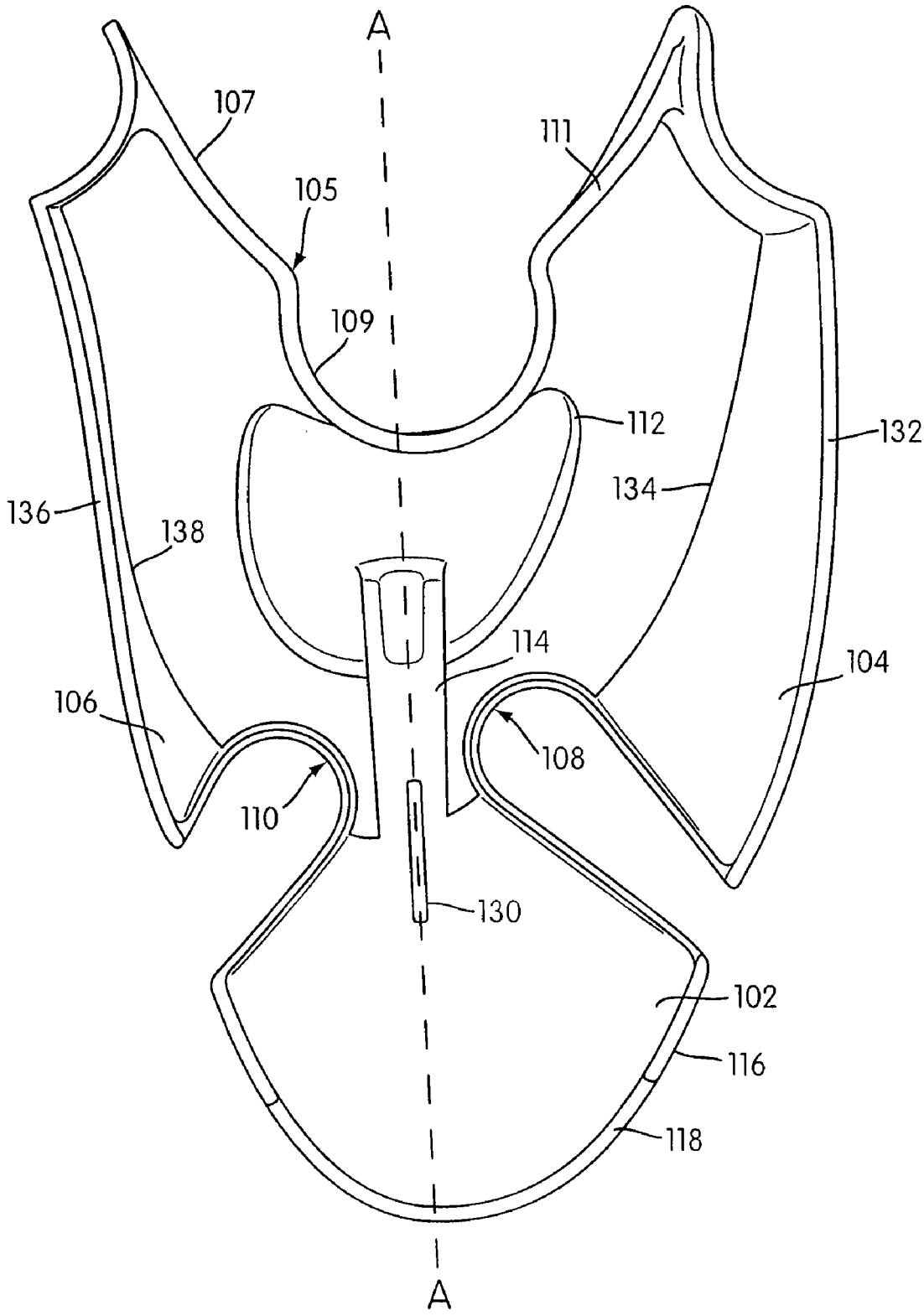
FIG. 7 is a bottom plan view of the shaping device of FIG. 1.

As best seen in FIGS. 3, 6-7, rear biasing member 105 has a molded construction for ease of manufacturing and resiliency benefits. Rear biasing member 105 comprises a medial leg 111 connected to a loop 109 which is the connected to a lateral leg 107. The loop 109 has a substantial semi-circular shape for resiliency benefits. The distal ends of the medial leg 111 and the lateral leg 107 are attached to the rear end of the medial portion 104 and lateral portion 106, respectively. Rear biasing member 105 may attached thereto via adhesive bonding. Alternatively, the rear biasing member 105 may be molded integrally with shoe tree 100 components. The rear biasing member 105 may have a leaf spring type of construction.

Referring to FIGS. 1-9, the medial portion 104 and lateral portion 108 include medial and lateral concaved grip areas 124 disposed at the rear end. Grip portions 124 are sized and adapted to provide a user the ability of grasp the shoe tree 100 between their fingers or mechanical equipment fingers, such as in an manufacturing environment. In one example insertion operation, a user of the shoe tree 100 may grasp the grip portions 124 and apply opposing forces towards the heel-to-toe axis A-A (e.g., forces are directed transverse to axis A-A). These forces displaces the rear end of medial portion 104 and lateral portion 106 inward and cause spring members 108, 110 to resist pivot advancement thereby creating biasing forces.

Hence, shoe tree 100 may be inserted into the interior void of the upper 12 such that the toe portion 102 is placed in an abutment relation with toe box of the upper 12. In a construction with the rear biasing element 105, the biasing element 105 becomes compressed as the applied forces to grip portions 124 overcomes the internal biasing forces of element 105. The grip portions 124 may be released so that the medial portion 104 and lateral portion 108 elastically move into position against the upper 12 to perform a function of maintaining the shape of the upper 12.

Shoe tree 100 may be constructed from a multitude of materials. In example, shoe tree 100 may be constructed of a lightweight plastic material. Portions or components of shoe tree 100 can be formed by injection molding a plastic resin into a desired shape. In a preferred construction, shoe tree 100 is unitarily molded, such that the pieces are integral. If desired, a plastic resin may be filled approximately 10% to 25% fiber material by volume to form a plastic resin composite. The plastic resin composite may be an enhanced resin having a filled fibrous composition, such as nylon, or glass. The resin may be polyester or a similar material. In one arrangement, the fibers may be a chopped type mixed in the resin. Nevertheless, other materials and methods can form the shoe tree 100, such as metal or combination of plastic and metal. For example, in one construction, shoe tree 100 can be formed with recyclable materials, such as a suitable thermoplastic urethane elastomer (TPU).

Figure 8:
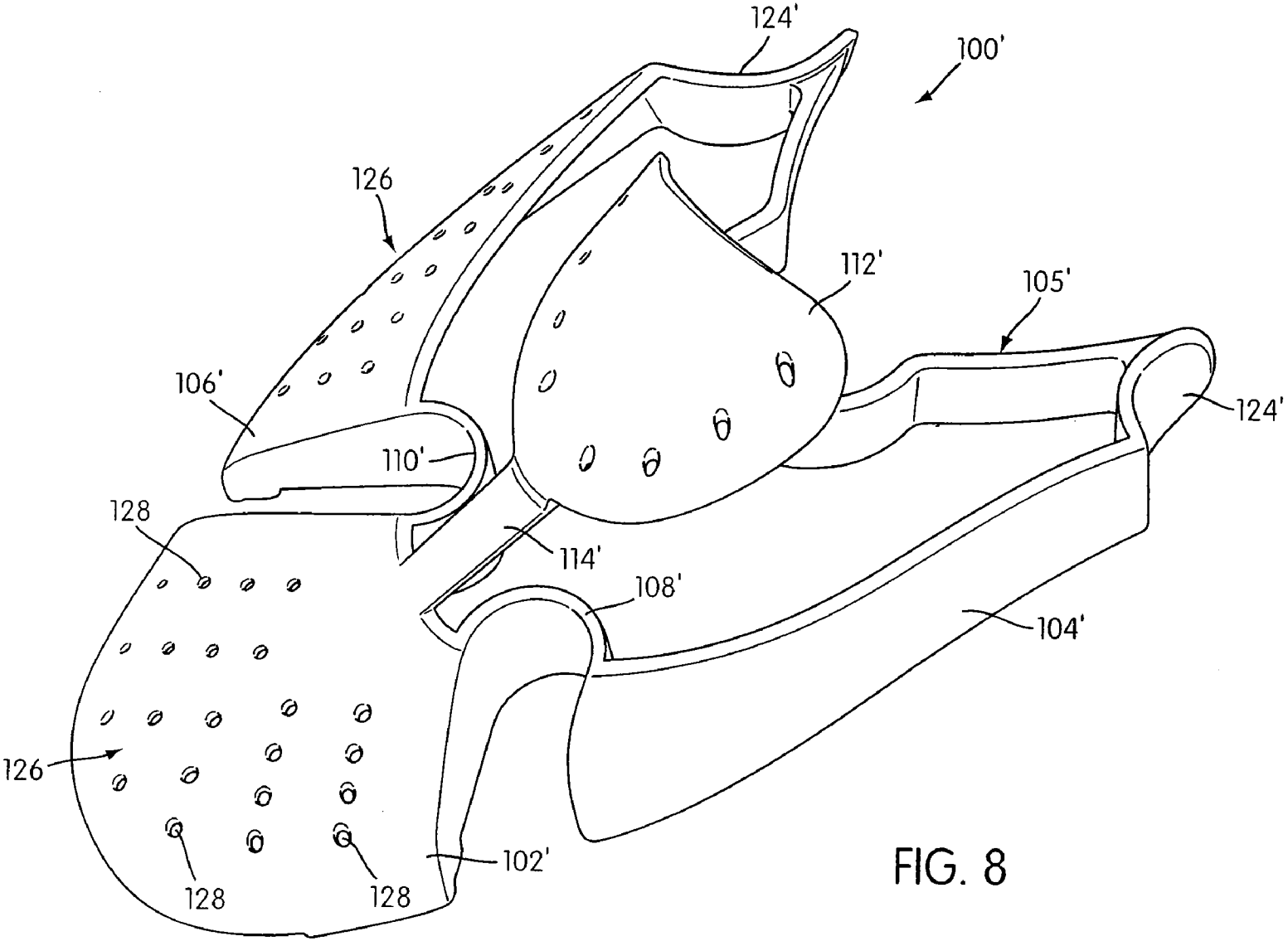
FIG. 8 is a perspective view of an alternative embodiment of an upper shaping device according to one or more aspects of the present invention.

FIG. 8 shows an alternative construction of a shoe tree 100'. Shoe tree 100' has a similar construction as shoe tree 100, except that shoe tree 100' enables a gaseous substance, such as air, to enter to the interior void of an upper through the wall thickness so as to ventilate the upper. In this regard, shoe tree 100' includes a plurality of aeration regions 126 disposed in the toe portion 102', or the middle portion 112'. Nevertheless, aeration regions may be provided on the medial portion 104' and/or the lateral portion 106'. Aeration regions 126 advantageously enable ambient air to be conveyed so as to provide breathability to ventilate the upper and/or increase evaporation of moisture. The breathability function is achieved in which the aeration region 126 includes a plurality of spaced perforations 128 which extend through the wall thickness of shoe tree 100. Nonetheless, the perforations 128 could be arranged randomly or in a myriad of different ordered patterns. Hence, the aeration region is advantageous in such a shoe tree because the region allows the upper to breathe to keep interior relatively dry.

Figure 10:
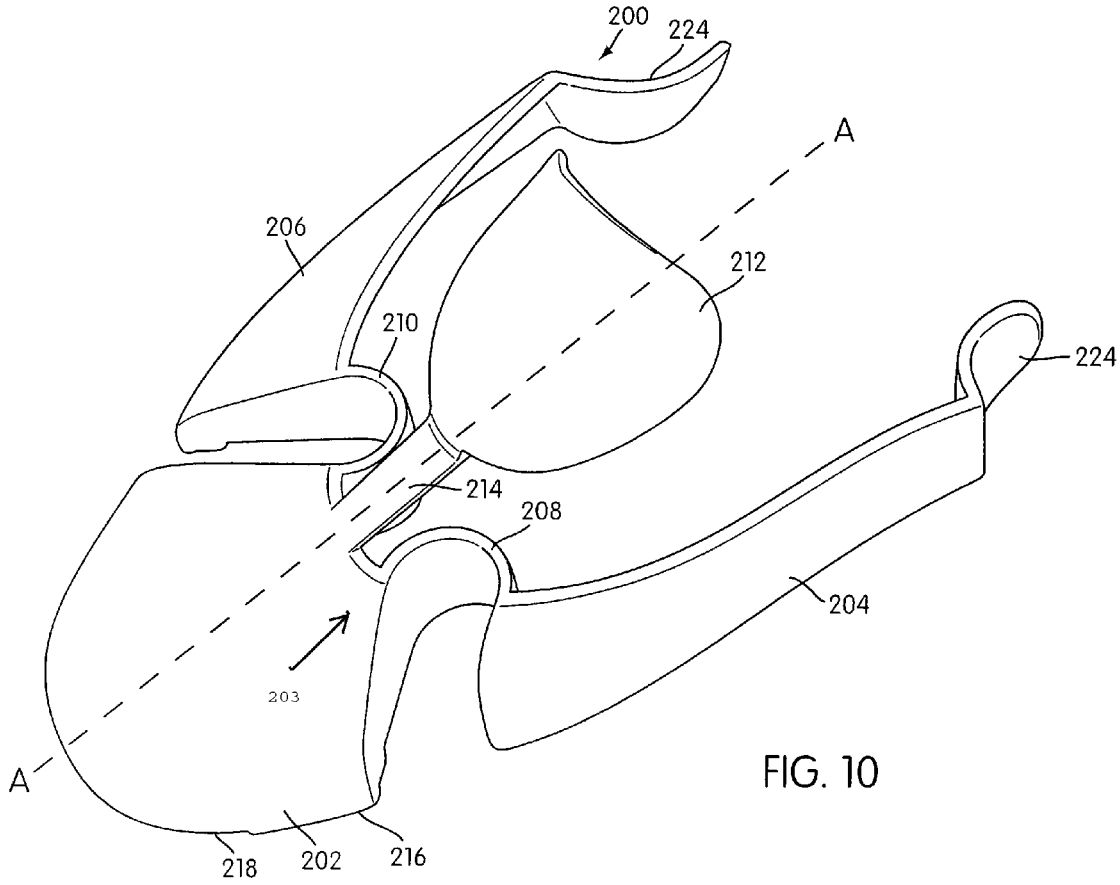
FIG. 10 is an alternative embodiment of the shaping device without a rear biasing element according to the teaches of the present invention.
Figure 11:
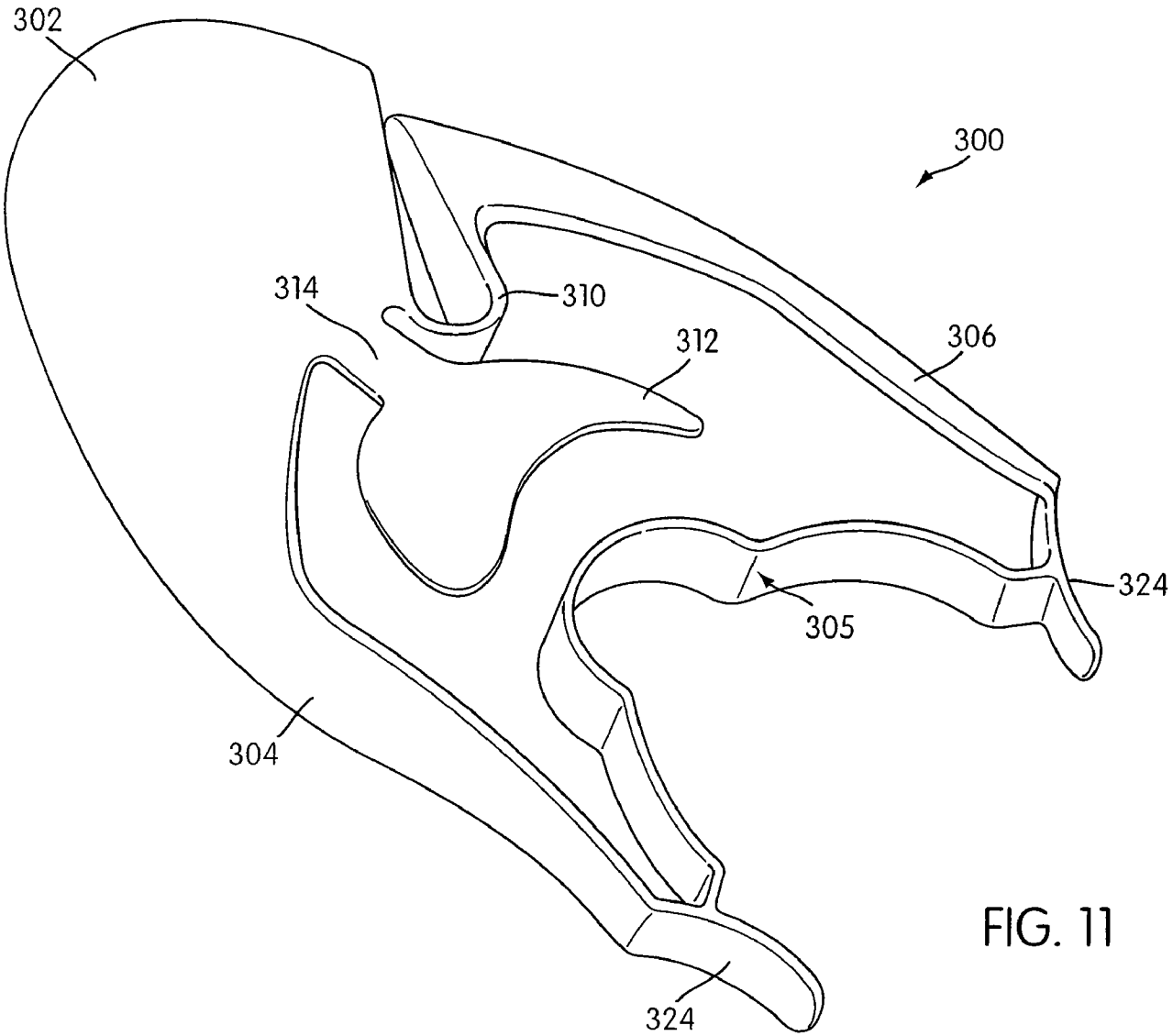
FIG. 11 is a perspective view of an alternative embodiment of the shaping device according to the teachings of the present invention.
Figure 12:
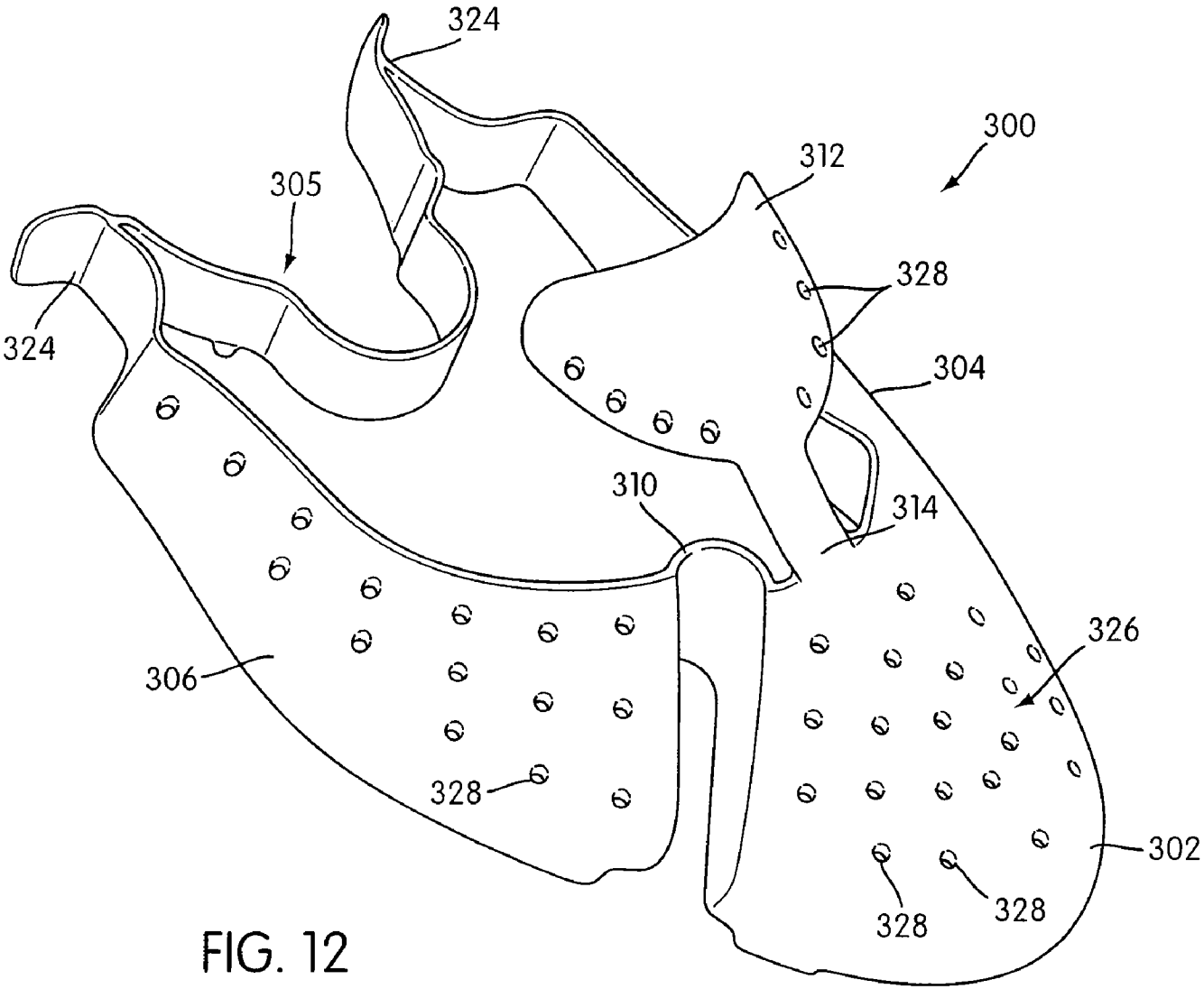
FIG. 12 is a perspective view of an alternative embodiment of the shaping device according to the teachings of the present invention.
Figure 13:
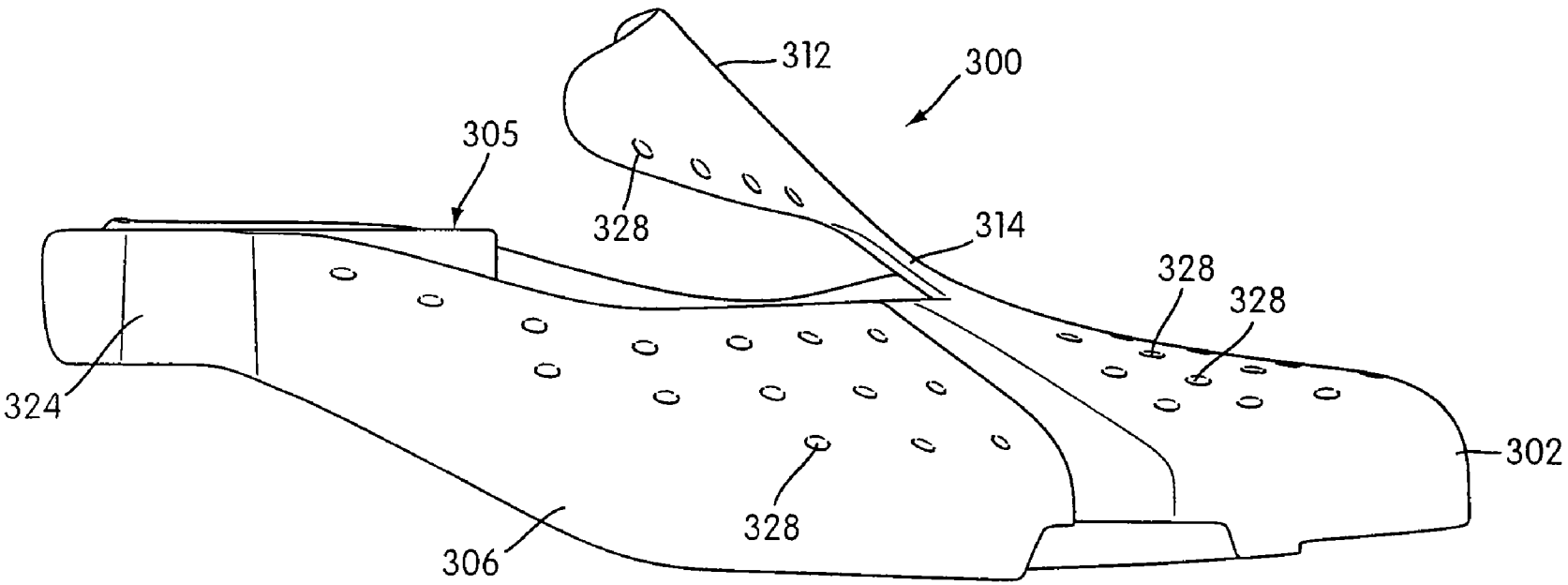
FIG. 13 is a side view of an alternative embodiment of the shaping device according to the teachings of the present invention.
Figure 14:
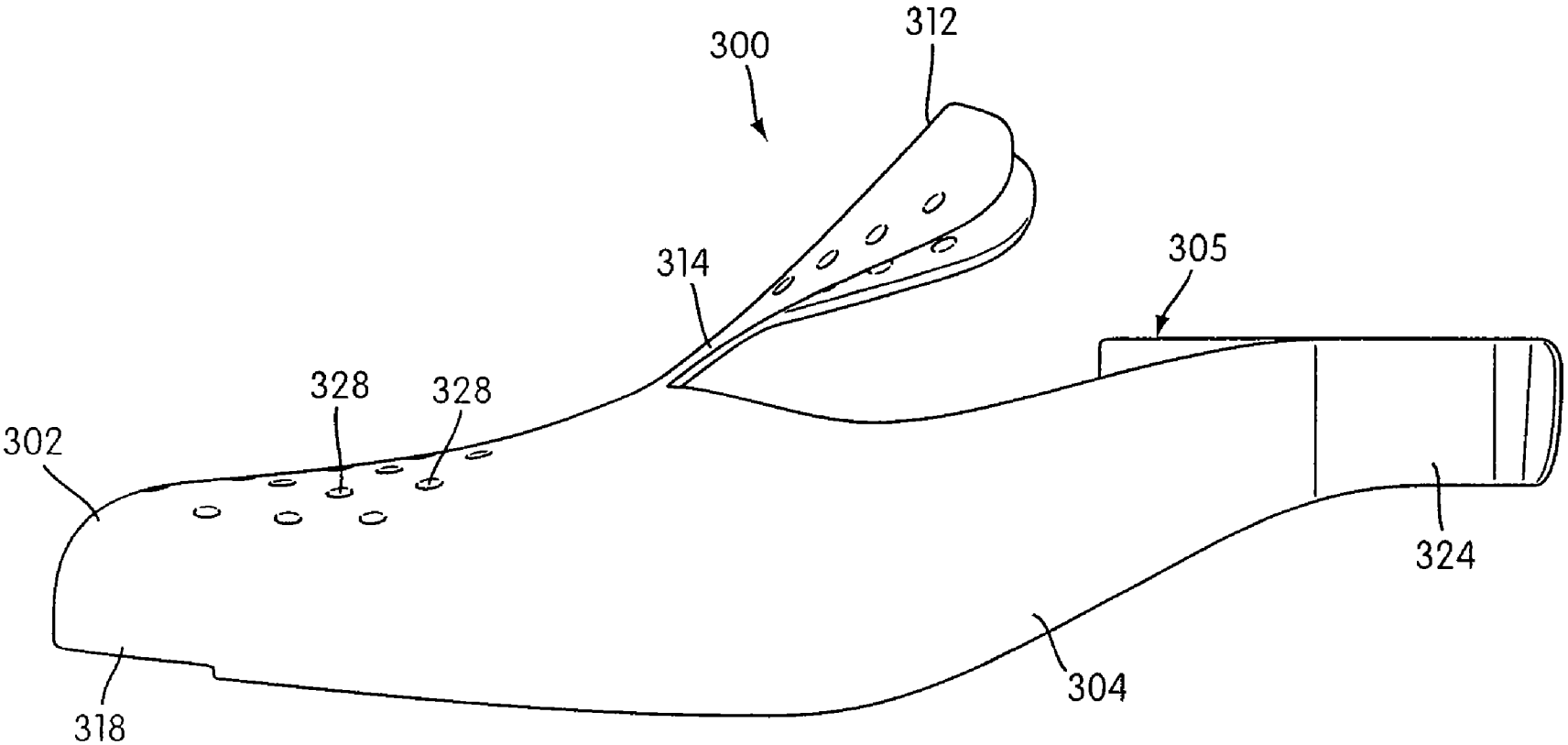
FIG. 14 is a side view of the other side of the alternative embodiment of the shaping device of FIG. 13 according to the teachings of the present invention.

FIG. 10 illustrates an alternative construction of a shoe tree 200 without the rear biasing element. Shoe tree 200 has a similar construction and material composition as shoe tree 100. Shoe tree 200 includes a toe portion 202 which maintains the shape of the forefoot toe region of an upper. The toe portion 202 may be resiliently connected a medial portion 204 and a lateral portion 206 via a spring assembly 203. Shoe tree 200 includes a central or middle portion 212 which extends in a resilient cantilevered manner upwardly from the toe portion 202. The middle portion 212 is connected to the toe portion 202 by way of a resilient biasing element or spring 214. Further, spring assembly 203 may include medial spring member 208 or lateral spring member 210 may be provided on shoe tree 200. Grip portions 224 may be provided on the rear end of the medial portion 204 and lateral portion 206.

While a description of preferred constructions of the shoe tree has been discussed, it should be understood that the benefits of the invention can still be obtained with a wide variety of other constructions. For example, the material composition comprising the shoe tree can be incorporated with a beneficial substance for foot care. In one construction, a compound (e.g., dischargeable substance), such as an antibacterial agent, can be released from the shoe tree 100 to reduce or otherwise eliminate bacteria from the exterior surfaces or in the interior of the upper 12. The compounds can be selected so as to provide an antibacterial benefit against such common microbes as fungi, viruses, bacteria, and other microbes. Nevertheless, the compound can be antimicrobial, antimold, antifungal (fungicide), antimildew, or antivirus. In this way, fungi or other malicious organisms may be eliminated by insertion of the shoe tree 100 into the shoe 10. Hence, a user has a reduced chance of contracting an infection or other bio-aliments in the foot or other hands (due to physical handling).

In another construction, compounds, odor control agents and deodorants (e.g., dischargeable substances), can be released from the shoe tree 100 to reduce or otherwise eliminate odors. In yet another construction, a chemical substance, such as a fragrance, may be added to the shoe tree material or on its exterior. For example, the shoe tree 100 may be covered, coated, or otherwise provided with a fragrance. While a fragrance coating is preferred, the coating also could be an anti-bacterial agent, a deodorants, or in combination.

In one aspect, the intermediate portion 112 of shoe tree 100 is provided to facilitate marketing of the article of the footwear. In this regard, the middle portion 112 may be provided with a branding indicia attached by way of bonding or a mechanical manner or a molded construction. A customer can look inside of the shoe 10 and "see" the branding indicia within the upper 20. Thus, customers can be further motivated to purchase the shoe 20. Nevertheless the branding indicia can be on other parts of the shoe tree 100.

It is noted that the features of the shoe tree 100 individually and/or in any combination, may improve stability, propulsion, or acceleration for the wearer of the shoe by maintaining an appropriate shape of the upper. While the various features and aspects of shoe tree 100 work together to achieve the advantages previously described, it is recognized that individual features and sub-combinations of these features can be used to obtain some of the aforementioned advantages without the necessity to adopt all of these features. For example, the previously described features of shoe tree 100 can be implemented without rear biasing element 105 (See FIG. 10).

In another example of the present invention, FIGS. 11-14 illustrate alternative constructions of a shoe upper shaping device referred to herein a shoe tree 300. Shoe tree 300 has a similar construction as shoe tree 100, except that lateral member 306 is moveably biased with respect to the toe portion 302. A lateral spring 310 is provided between the lateral portion 306 and the toe portion 302. Alternatively, a medial spring could be provided in lieu of a lateral spring 310. Nevertheless, the shoe tree 300 includes a central or intermediate portion 312 which extends in a resilient cantilevered manner upwardly from the toe portion 302. The middle portion 312 is resiliently connected to the toe portion 302 via a resilient biasing element or spring 314. A notch 318 is provided similar to structure and function as notch 118 (See FIGS. 1-2) Handling portions 324 for gripping may be provided on the rear end of the medial portion 304 and lateral portion 306. A rear spring 305 spans between the medial portion 304 and lateral portion 306. Advantageously, footwear can be provided with uppers to meet various sizes of the foot of a wearer and maintain a proper fit for the foot for performance. This alternative construction can have a shoe tree apparatus 300 for an upper of a shoe in which two opposing shaping members 304, 306 are disposed reward of a toe shaping portion 302. One of the shaping portions is configured to outwardly bias against a medial side or a lateral side of the upper. The shaping portion may be configured to bias with respect to the toe shaping portion 302 with a spring. In a preferred construction, an intermediate portion 312 can extend at angle upwardly from the toe shaping portion 302 and is resiliently biased with a biasing member, such as spring 314. In one example, the noted angle may be range from 10 degrees to 80 degrees with respect a horizontal reference plane. In another example, the angle may range between 40 degrees to 60 degrees from horizontal. Nevertheless, other ranges of the angle are possible.

In another construction, shoe tree 300 can be provided so as to enable air to enter to the interior void of an upper through the wall thickness for ventilating the shoe upper. In this regard, shoe tree 300 may include a plurality of aeration regions 326 disposed in the toe portion 302 or the middle portion 312. Nevertheless, aeration regions may be provided on the medial portion 304 and/or the lateral portion 306. Aeration regions 326 advantageously enable ambient air to be conveyed so as to provide breathability to ventilate the upper and/or increase evaporation of moisture. The breathability function is achieved in which the aeration region 326 includes a plurality of spaced perforations 328 which extend through the wall thickness of shoe tree 300. Hence, the aeration region is advantageous in such a shoe tree because the region allows the upper to breathe to keep interior relatively dry.

While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention will include all embodiments falling within the scope of the appended claims.

What is claimed is:

1. A shoe tree apparatus for an upper of a shoe, comprising:

a toe shaping member;

at least two opposing shaping members disposed reward of the toe shaping member and one of the at least two opposing shaping members being configured for outward biasing against a medial side or a lateral side of the upper and the one of the at least two opposing shaping members being configured for biasing with respect to the toe shaping member;

an intermediate shaping member extending upwardly from the toe shaping member and being resiliently biased therefrom;

wherein the toe shaping member, the at least two opposing shaping members and the intermediate shaping member comprise a resilient plastic composite material composed of a dischargeable substance and a plurality of fibers;

wherein the at least two opposing shaping members comprise a medial member and a lateral member, the medial member and the lateral member each including a rear end disposed away from the toe shaping member, the rear end of each of the medial member and the lateral member being provided with a concaved gripping portion for a compressive force;

wherein the rear ends of the medial member and the lateral member include a V-shaped spring extending therebetween so as to provide the biasing force, wherein an apex of the V-shaped spring is disposed in a direction towards the toe shaping member;

wherein the medial member and the lateral member each includes a forward end disposed proximate to the toe shaping member;

a spring assembly including a medial spring attached to the forward end of the medial member and a lateral spring attached to the forward end of the lateral member, in which the medial and lateral springs are attached to the toe shaping member; and wherein a medial spring opening is formed between the toe shaping member and the medial member and a lateral spring opening is formed between the toe shaping member and the lateral member such that the toe shaping member is separated and spaced from the medial and lateral members by the medial and lateral spring openings respectively.

2. The apparatus according to claim 1, wherein the V-shaped spring includes a loop and opposing legs coupled to the rear ends of the medial member and the lateral member.

3. The apparatus according to claim 1, wherein the intermediate shaping member includes a biasing member extending angularly from the toe shaping member.

4. The apparatus according to claim 1, wherein at least one of the toe shaping member and the opposing shaping members further comprise a plurality of air perforations.

5. The apparatus according to claim 1, wherein the toe shaping member includes a forward edge and the forward edge includes a notched portion for easing engagement of the toe shaping member within the upper.

6. The apparatus according to claim 1, wherein at least one of the medial and lateral springs is a forward biasing member.

7. The apparatus according to claim 6, wherein the forward biasing member is shaped substantially in a leaf spring configuration.

8. A shoe tree apparatus, comprising:

a toe shaping member;

a medial member for engaging a medial side of an upper;

a lateral member for engaging a lateral side of an upper;

an intermediate member extending from the toe shaping member and being biased therefrom;

a forward spring assembly connected to the medial member and the lateral member for biasing against the toe shaping member, said medial and lateral members being configured for maintaining the shape of an upper of an article of footwear;

a rear spring laterally extending between the medial member and the lateral member;

wherein the toe shaping member, the medial member, the lateral member, the rear spring and the intermediate member comprise a molded construction of a resilient plastic composite material composed of a dischargeable substance;

wherein the medial member and the lateral member each include a forward end disposed proximate to the toe shaping member, and a rear end disposed away from the toe shaping member;

wherein the forward spring assembly includes a medial spring attached to the forward end of the medial member and a lateral spring attached to the forward end of the lateral member, in which the medial and lateral springs are attached to the toe shaping member; and wherein a medial spring opening is formed between the toe shaping member and the medial member and a lateral spring opening is formed between the toe shaping member and the lateral member such that the toe shaping member is separated and spaced from the medial and lateral members by the medial and lateral spring openings respectively.

9. The apparatus according to claim 8, wherein the intermediate member includes a biasing member extending upward from the toe shaping member.

10. The apparatus according to claim 8, wherein the rear end of each of the lateral member and the medial member is provided with a concaved gripping portion for applying a compressive force to overcome a biasing force provided by the rear spring.

11. The apparatus according to claim 8, wherein the medial spring and the lateral spring are shaped substantially in a leaf spring configuration.

12. The apparatus according to claim 8, wherein at least one of the toe shaping member, the medial member, the lateral member, and the intermediate member further comprises a plurality of air perforations.

13. The apparatus according to claim 1, wherein the dischargeable substance comprises an antibacterial material.

14. The apparatus according to claim 8, wherein the dischargeable substance comprises an antibacterial material.

15. The apparatus according to claim 8, wherein the plastic composite material includes a plurality of nylon or glass fibers.

16. The apparatus according to claim 1, wherein the plastic composite material includes a plurality of nylon or glass fibers.

17. The apparatus according to claim 1, wherein the plastic composite material comprises 10% to 25% fibers as measured by volume.

* * * * *